US011339792B2

(12) United States Patent
Li

(10) Patent No.: US 11,339,792 B2
(45) Date of Patent: May 24, 2022

(54) AIR PUMP WITH AUTOMATIC STOP OF INFLATION AND DEFLATION

(71) Applicant: WangLi Plastic & Electronics (Huizhou) Co., Ltd., Guangdong (CN)

(72) Inventor: Yonghe Li, Guangdong (CN)

(73) Assignee: Wangli Plastic & Electronics (Huizhou) Co., Ltd., Guangdong (CN)

( * ) Notice: Subject to any disclaimer, the term of this patent is extended or adjusted under 35 U.S.C. 154(b) by 58 days.

(21) Appl. No.: 17/039,780

(22) Filed: Sep. 30, 2020

(65) Prior Publication Data

US 2021/0018013 A1 Jan. 21, 2021

Related U.S. Application Data

(63) Continuation-in-part of application No. 16/001,210, filed on Jun. 6, 2018, now Pat. No. 10,851,796.

(30) Foreign Application Priority Data

Sep. 5, 2017 (CN) ..... 201721132061.9

(51) Int. Cl.

| | |
|---|---|
| ***F04D 27/00*** | (2006.01) |
| ***F04D 25/08*** | (2006.01) |
| ***F04D 25/06*** | (2006.01) |
| ***F04D 29/50*** | (2006.01) |
| ***A47C 27/08*** | (2006.01) |

(52) U.S. Cl.

CPC ..... *F04D 27/008* (2013.01); *A47C 27/082* (2013.01); *F04D 25/06* (2013.01); *F04D 25/08* (2013.01); *F04D 29/503* (2013.01)

(58) Field of Classification Search

CPC ..... F04D 29/503; F04D 17/10; F04D 17/16; F04D 25/06; F04D 25/08; F04D 27/008; F04D 29/083; F04D 29/403; F04D 29/4206; F04D 29/701; A47C 27/08

See application file for complete search history.

(56) References Cited

U.S. PATENT DOCUMENTS

2008/0201857 A1* 8/2008 Kelly ..... F04D 25/084 5/713
2010/0247337 A1* 9/2010 Tsai ..... A47C 27/082 417/239

(Continued)

FOREIGN PATENT DOCUMENTS

CN 201963573 U 9/2011
EP 1961335 A1 8/2008

*Primary Examiner* — Dominick L Plakkoottam

(74) *Attorney, Agent, or Firm* — Muncy, Geissler, Olds & Lowe, P.C.

(57) ABSTRACT

An air pump with automatic stop of inflation and deflation includes a housing provided with a first air inlet/outlet and a second air inlet/outlet. The inside of the housing is provided with a knob mechanism, an inflation and deflation linkage and an air channel switching mechanism which is connected to the product to be inflated or deflated through the second air inlet/outlet. The inflation and deflation linkage controls the air channel switching mechanism to be operatively connected to the knob mechanism which controls the displacement of the air channel switching mechanism so as to be communicated with the product to achieve inflation or deflation or not to be communicated with the product to achieve automatic stop of inflation or deflation.

19 Claims, 17 Drawing Sheets

(56) References Cited

U.S. PATENT DOCUMENTS

| | | | | |
|---|---|---|---|---|
| 2010/0247356 | A1* | 9/2010 | Tsai | A47C 27/082<br>417/423.14 |
| 2012/0107153 | A1* | 5/2012 | Liu | F04B 35/06<br>417/410.1 |
| 2015/0316067 | A1* | 11/2015 | Tsai | F04D 17/16<br>417/15 |
| 2016/0123349 | A1* | 5/2016 | Wang | F04D 29/503<br>415/175 |

* cited by examiner

AIR PUMP WITH AUTOMATIC STOP OF INFLATION AND DEFLATION

CROSS REFERENCE TO RELATED APPLICATIONS

The present application is a continuation-in-part of application Ser. No. 16/001,210, filed on Jun. 6, 2018, which claims priority from Chinese Patent Application No. 201721132061.9 filed on Sep. 5, 2017, all of which are hereby incorporated herein by reference.

TECHNICAL FIELD

The present application relates to the technical field of air pumps, in particular to an air pump with automatic stop of inflation and deflation.

BACKGROUND ART

Currently, inflatable products are more and more popular with consumers because of the characteristics of being convenient to carry and store. Without the disadvantage of bulkiness of conventional mattress, the air bed in the prior art can be placed indoors and outdoors at will, is small in size after deflation and convenient to carry and store, and is suitable for household use, temporary bed making for guests, office lunch break, and travel camping and the like.

The use and storage of inflatable products generally require inflation or deflation. In the prior art, inflation and deflation of the inflatable product is mainly achieved through an inflatable and deflatable air pump. Some large inflatable products are generally equipped with inflatable and deflatable air pumps on which air inlets are arranged. When the inflatable product is inflated, the air inlet is opened, and the inflatable and deflatable air pump can fill the inner chamber of the inflatable product with air. After the inflation is completed, the air inlet is closed to prevent the air in the inflatable product from leaking.

However, during operation of the existing inflatable and deflatable air pumps, human involvement is usually needed to make sure whether the air within the inflatable product is sufficient and whether to continue or stop inflation. As a result, errors tend to be generated and the inflatable product cannot reach an optimum state. Since it is required to artificially monitor the progress of inflation and deflation, human and material resources and time are wasted.

In addition, the power line of the inflatable air pump in the prior art is generally exposed to the outside of the inflatable product, so that the appearance of the inflatable product is affected and the power line is easy to be damaged. In some cases, the power line is detachably connected to the power interface of the inflatable air pump, but due to the fact that the inflatable product often needs to be inflated and deflated, frequent plugging and unplugging can cause inconvenience to people, safety accidents are also prone to happen, or the power interface is easy to be worn with poor contact. On the other hand, it happens that the power line is forgotten since the inflatable product needs to be carried around frequently while the power line is taken just when needed.

SUMMARY OF THE INVENTION

In view of the above, it would be desirable to provide an improved air pump which is able to automatically stop to inflate and deflate.

According to the present invention, the air pump comprises a housing provided with a first air inlet/outlet and a second air inlet/outlet. The inside of the housing is provided with a knob mechanism, an inflation and deflation linkage and an air channel switching mechanism which is connected to a product to be inflated or deflated through the second air inlet/outlet. The inflation and deflation linkage controls the air channel switching mechanism to be operatively connected to the knob mechanism which can control the displacement of the air channel switching mechanism so as to be communicated with the product to be inflated or deflated to achieve inflation or deflation or to be not communicated with the product to be inflated or deflated to achieve automatic stop of inflation or deflation. When the knob mechanism is fastened to the inflation and deflation linkage, the air channel switching mechanism is communicated with the product to be inflated or deflated; and when the knob mechanism is unfastened to the inflation and deflation linkage, the knob mechanism rotates and the air channel switching mechanism is not communicated with the product to be inflated or deflated. The inflation and deflation linkage includes ducts and a pressure valve. One end of the duct is communicated with the air pressure in the product to be inflated or deflated, and the other end is connected with the pressure valve. When the air pressure in the duct reaches a set pressure value, the pressure valve moves and controls the knob mechanism to rotate, so that the air channel switching mechanism is not communicated with the product to be inflated or deflated to achieve automatic stop of inflation or deflation.

The inflation and deflation linkage is provided to monitor the air pressure of the product to be inflated or deflated during inflation and deflation. Therefore, when the air pressure in the inflatable product reaches a set air pressure value, the inflation and deflation of the product to be inflated or deflated is stopped in time, and the effect of automatic stopping the inflation and deflation is achieved.

The duct is provided to monitor the air pressure in the inflatable product. Since the duct is communicated with the inflatable product, the air pressure of the duct is the same as that in the inflatable product. The pressure valve is communicated with the duct, moves up and down according to the air pressure of the duct, and adjusts the knob mechanism when moving up and down, so that the knob mechanism moves accordingly. Since the knob mechanism is connected with the air channel, the air channel moves along with the knob mechanism, and thus the communicated state between the air channel and the product to be inflated or deflated is changed, the automatic stop of inflation and deflation is achieved, and the automatic lever of the air pump is improved, which better meets the needs of the user.

EMBODIMENTS

Figure 1:
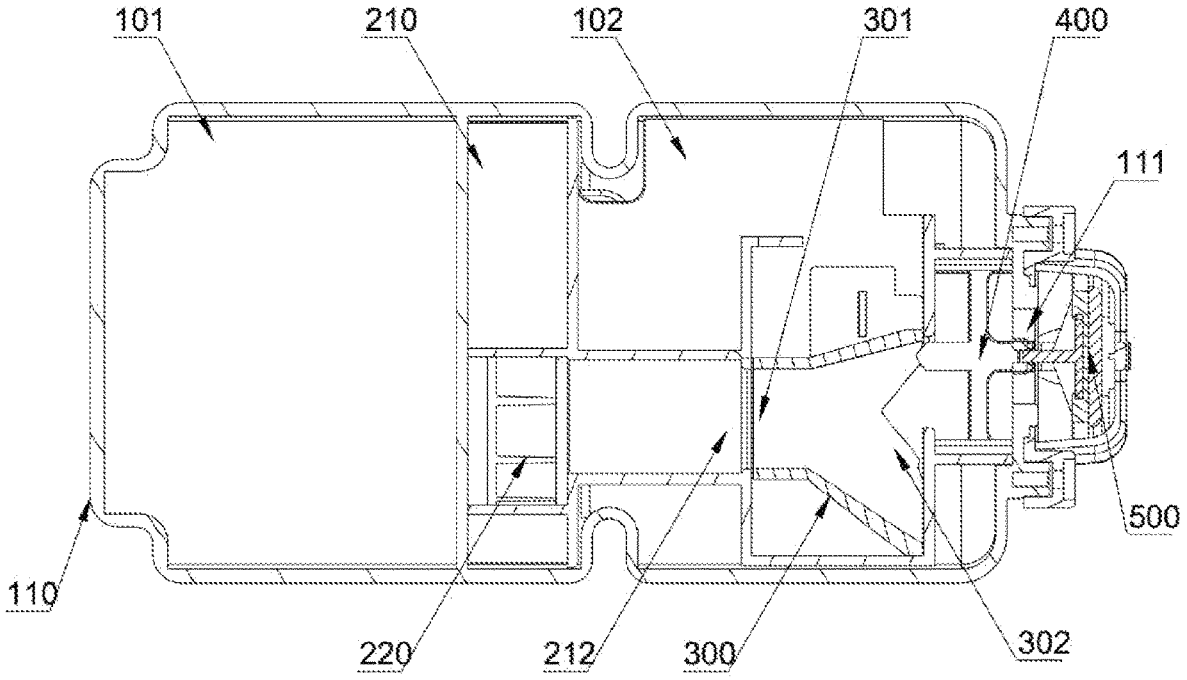
FIG. 1 is a schematic structural diagram of a single-knob air pump (inflated state) according to an embodiment.

In order to enable those skilled in the art to better understand the technical solutions of the present invention, the present invention will be further described below with reference to the accompanying drawings.

As shown in FIGS. 1 to 4, a single-knob air pump includes a housing comprising a wire slot accommodating chamber 101 and an assembly accommodating chamber 102; the housing includes a housing base 110 and a panel 120 provided with a detachable cover plate 130 corresponding to the wire slot accommodating chamber 101; and first air inlets/outlets 121 corresponding to the assembly accommodating chamber 102 are arranged on the panel 120, and a second air inlet/outlet 111 is arranged on the housing base 110. A gap 103 is provided between the wire slot accommodating chamber 101 and the assembly accommodating chamber 102, and the cover plate 130 is in non-sealing contact with the panel 120 so that air can flow through the gap, as shown by the arrow b in FIG. 11 and arrow e in FIG. 12.

Figure 3:
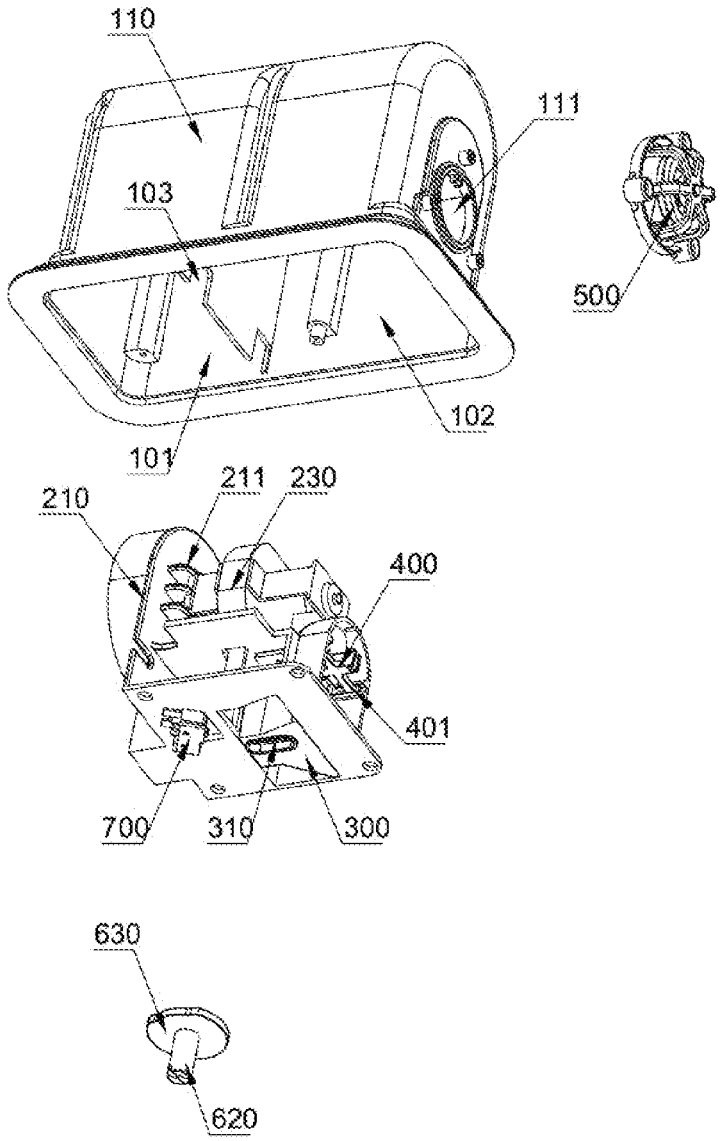
FIG. 3 is an exploded view of a local structure of the single-knob air pump according to the embodiment.
Figure 4:
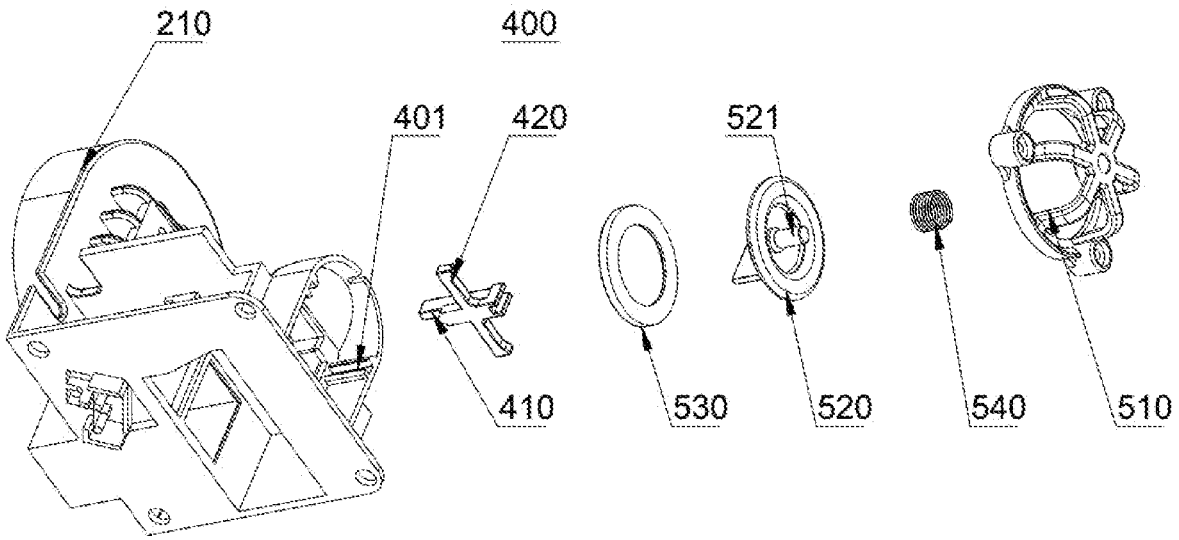
FIG. 4 is an exploded view of another local structure of the single-knob air pump according to the embodiment.
Figure 5:
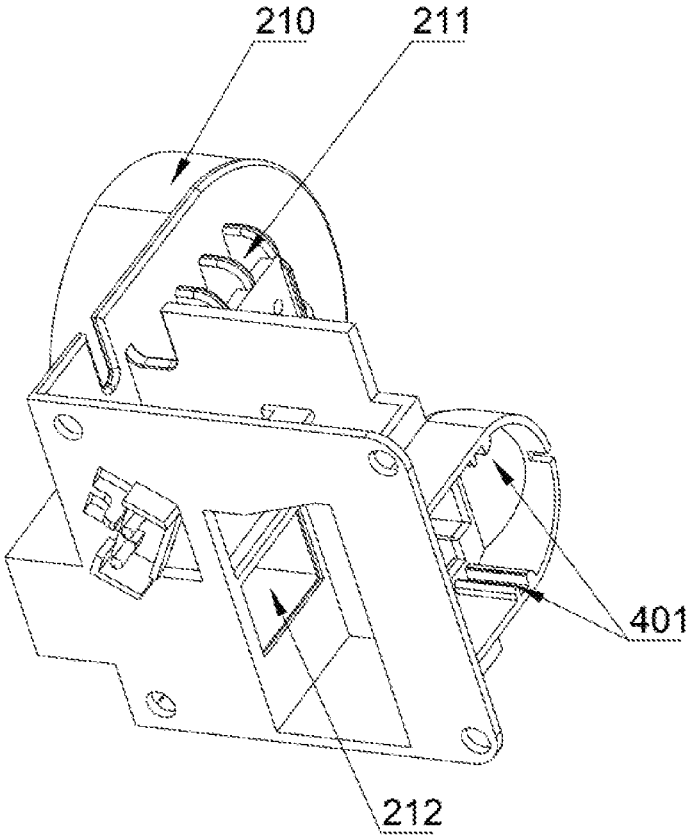
FIG. 5 is a schematic diagram of a local structure of the single-knob air pump according to the embodiment.
Figure 6:
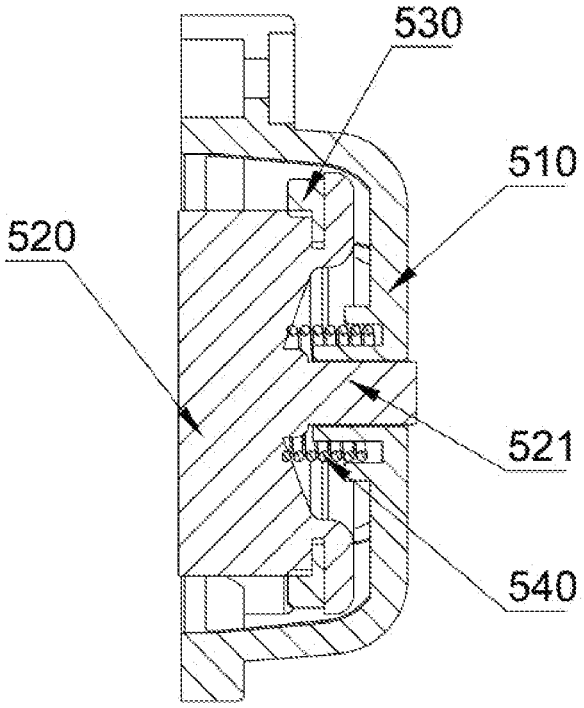
FIG. 6 is a schematic structural view of an air valve mechanism according to the embodiment.

As shown in FIGS. 3 to 5, an air extracting mechanism is arranged in the housing, which includes a motor 230 and fan blades 220. The fan blades 220 of the air extracting mechanism are arranged in a fan blade chamber 210 provided with an air inlet 211 and an air outlet 212.

As shown in FIGS. 1 to 8, an air channel switching mechanism 300 is arranged near the fan blade chamber 210 and is provided with an air inlet 301 and an air outlet 302; the air outlet 302 of the air channel switching mechanism 300 is provided with a V-shaped structure 320 including a first inclined plane 321 and a second inclined plane 322.

Figure 7:
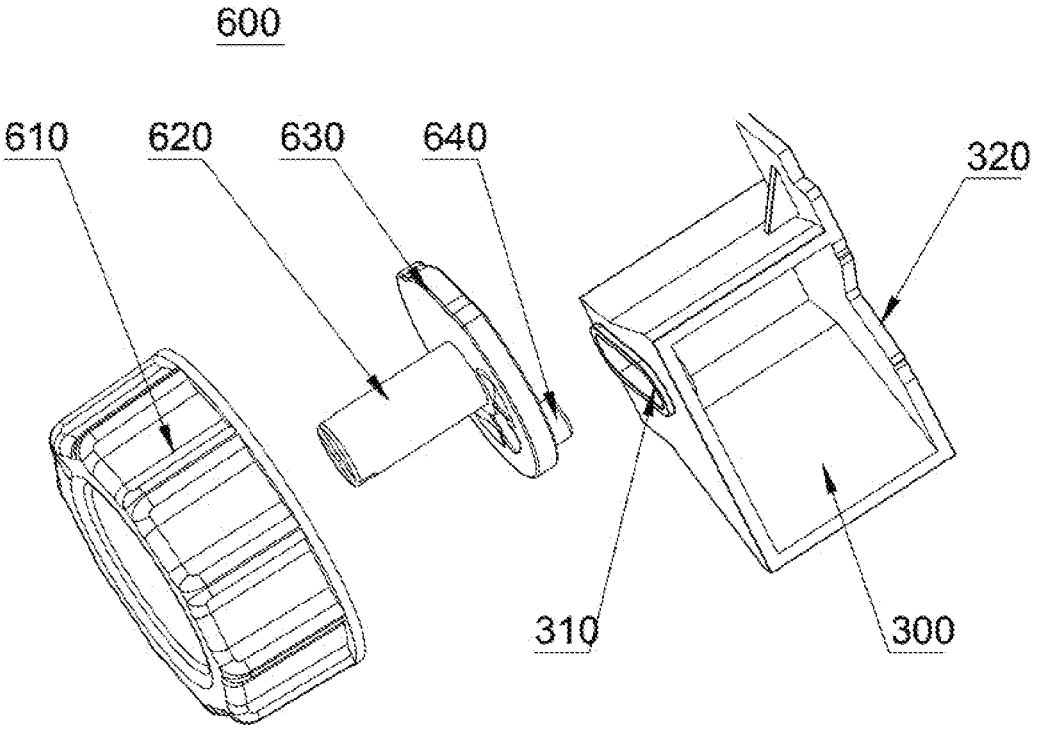
FIG. 7 is an exploded structural view of a knob mechanism according to the embodiment.
Figure 8:
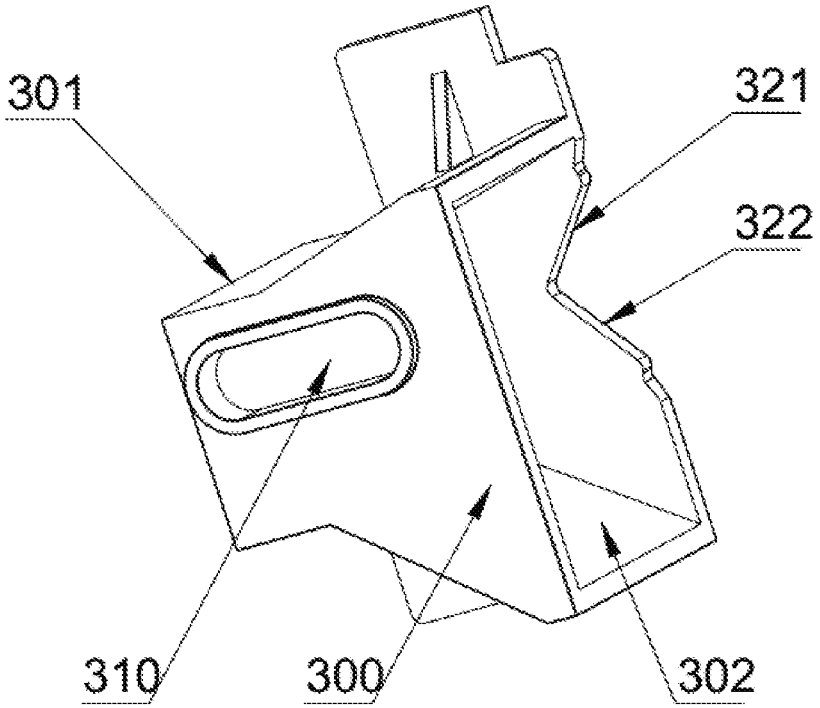
FIG. 8 is a schematic structural view of an air channel switching mechanism according to the embodiment.
Figure 9:
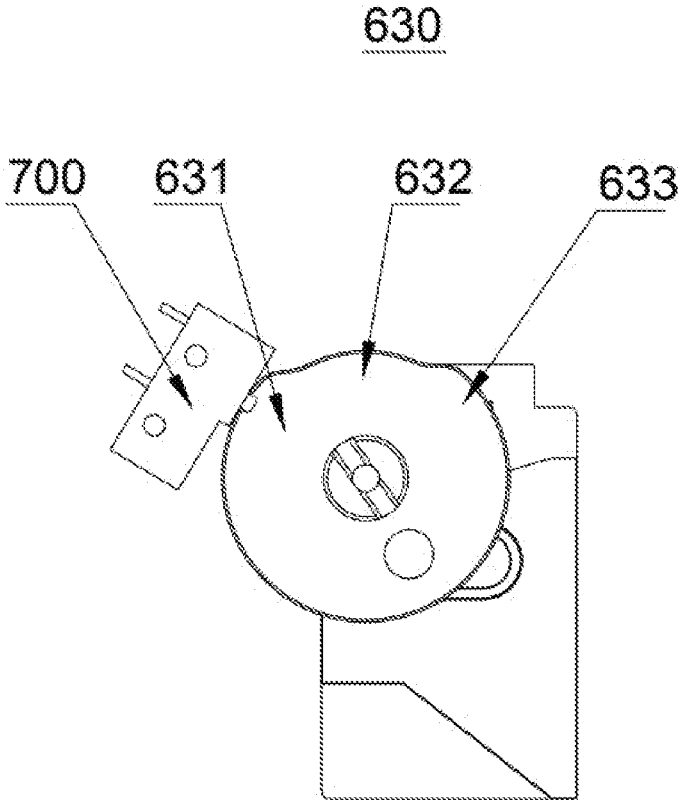
FIG. 9 is a schematic diagram showing the cooperation between the knob mechanism and a pressing switch (in inflated state) according to the embodiment.
Figure 10:
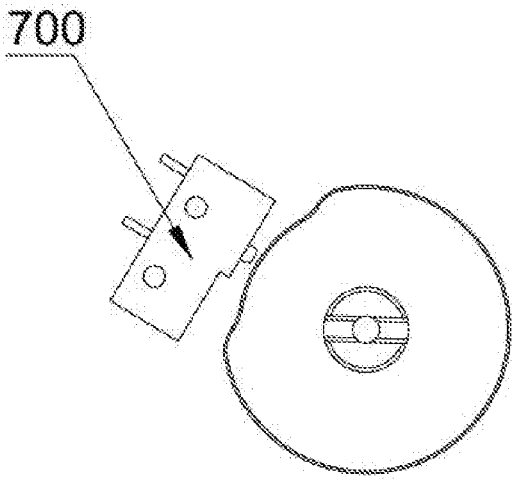
FIG. 10 is a schematic diagram showing the cooperation between the knob mechanism and the pressing switch (in stopped state) according to the embodiment.

As shown in FIG. 7 and FIG. 8, the air channel switching mechanism 300 is operatively connected to a knob mechanism 600 which can control the displacement of the air channel switching mechanism 300; the knob mechanism 600 includes an air channel switching paddle 630 which is rotatably arranged, a knob 610 is connected to the front surface of the air channel switching paddle 630 through a link rod 620, and a blocking rod 640 is arranged on the back surface thereof; and a sliding slot 310 is arranged on the air channel switching mechanism 300, and the blocking rod 640 is embedded in the sliding slot 310. As shown in FIG. 9, a pressing switch 700 that can control the operation of the motor is arranged near the air channel switching paddle 630; the edge of the air channel switching paddle 630 is provided with a contact portion for an inflated state 631, a contact portion for a deflated state 633 and a non-contact portion for a stopped state 632 between the contact portion for an inflated state and the contact portion foe a deflated state (as shown in FIG. 10, in the stopped state, the non-contact portion for stopped state 632 is separated from the pressing switch 700 to turn off the circuit).

Figure 2:
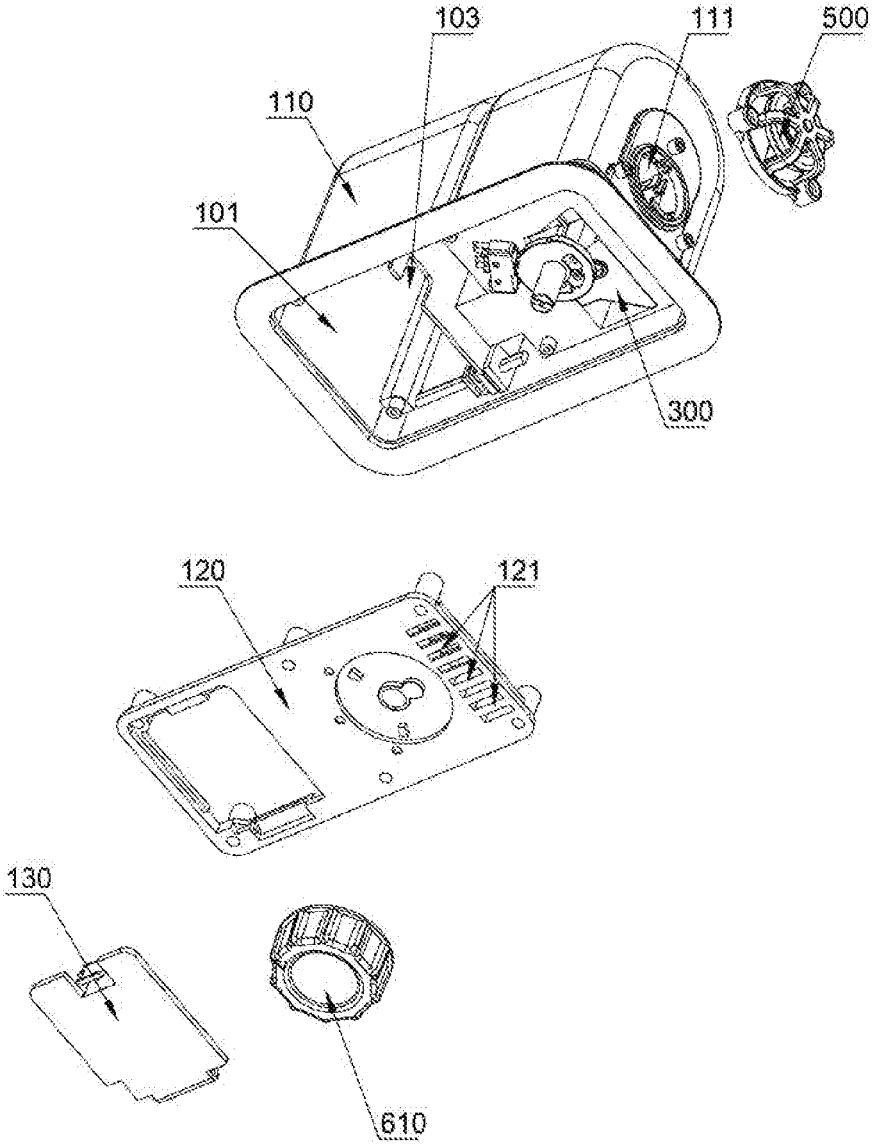
FIG. 2 is an exploded view of the single-knob air pump according to the embodiment.

As shown in FIGS. 2 and 4, the second air inlet/outlet 111 is provided with an air valve mechanism 500 capable of closing or opening the second air inlet/outlet 111, an ejector rod mechanism 400 capable of closing or opening the second air inlet/outlet through the air valve mechanism under the action of the air channel switching mechanism is arranged between the air valve mechanism 500 and the air channel switching mechanism 300. The ejector rod mechanism 400 includes a first ejector rod 410 and a second ejector rod 420 intersecting with each other, a pair of guide slots 401 are arranged in the housing, two ends of the second ejector rod 420 are embedded in the guide slots 401, one end of the first ejector rod 410 can abut the first inclined plane 321 or the second inclined plane 322 of the air channel switching mechanism, and the other end can operate the air valve mechanism 500.

The air valve mechanism 500 includes a breathable mesh cover 510 arranged on the second air inlet/outlet 111, and a seal assembly capable of being compressed or reset by the ejector rod mechanism 400 is arranged in the mesh cover 510; the seal assembly includes a platen 520 arranged in the mesh cover, the platen 520 is provided with a seal ring 530 which can be used for sealing and a guide rod 521 which can penetrate the mesh cover, and a spring 540 is sleeved outside the guide rod, between the platen and the mesh cover.

Figure 11:
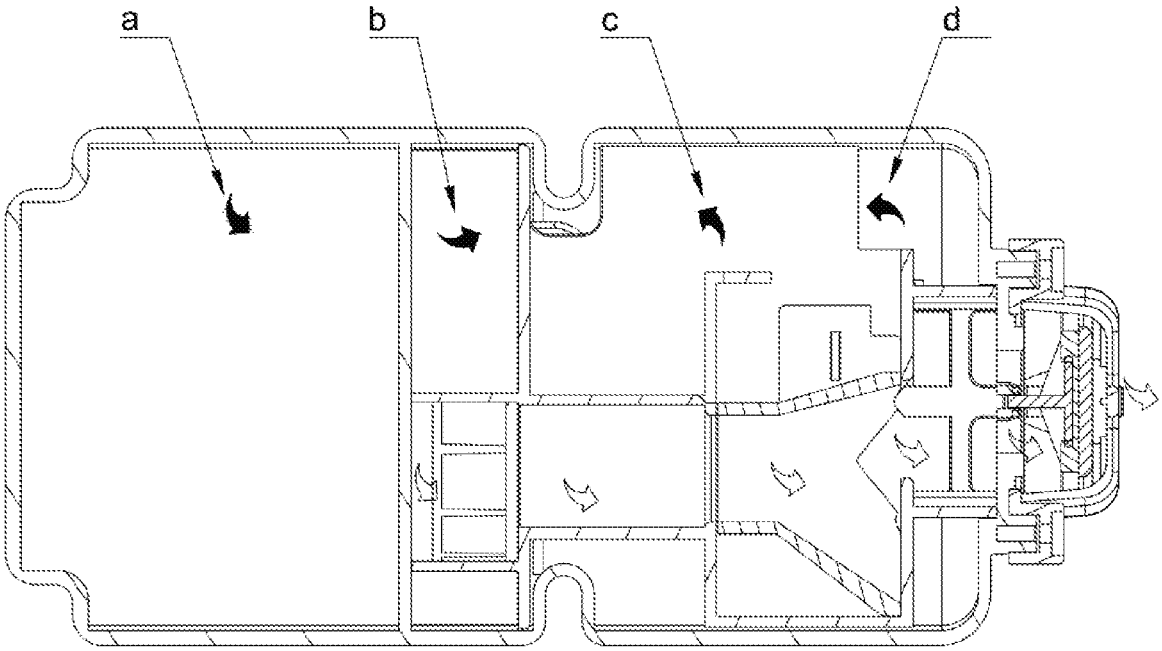
FIG. 11 is a schematic diagram of the present invention in inflated state according to the embodiment.

FIG. 11 shows the inflated state of the present invention, the knob mechanism is rotated, and the contact portion for an inflated state 631 of the air channel switching paddle 630 is brought into contact with the pressing switch 700 to turn on the circuit; at the same time, the air channel switching mechanism 300 moves downwards under the action of the blocking rod 640, so that the air inlet 301 of the air channel switching mechanism is brought into contact with and is communicated with the air outlet 212 of the fan blade chamber, the first inclined plane 321 of the air channel switching mechanism operates an end of the first ejector rod 410, and the other end of the first ejector rod 410 operates the air valve mechanism 500 with the guiding of the second ejector rod; and the platen 520 of the air valve mechanism is compressed toward the mesh cover 510, and the second air inlet/outlet 111 is opened, thus carrying out inflating. The flow of the air in inflation is shown by arrows in FIG. 11, an arrow "a" indicates that the air flow enters the wire slot accommodating chamber from a gap between the cover plate and the panel, an arrow "b" indicates that the air flow enters the assembly accommodating chamber from a gap between the wire slot accommodating chamber and the assembly accommodating chamber, an arrow "c" indicates that the air flow collected in the assembly accommodating chamber will enter the fan blade chamber from the air inlet of the fan blade chamber, and an arrow "d" indicates that the air flow enters the assembly accommodating chamber from the first inlet/outlet.

Figure 12:
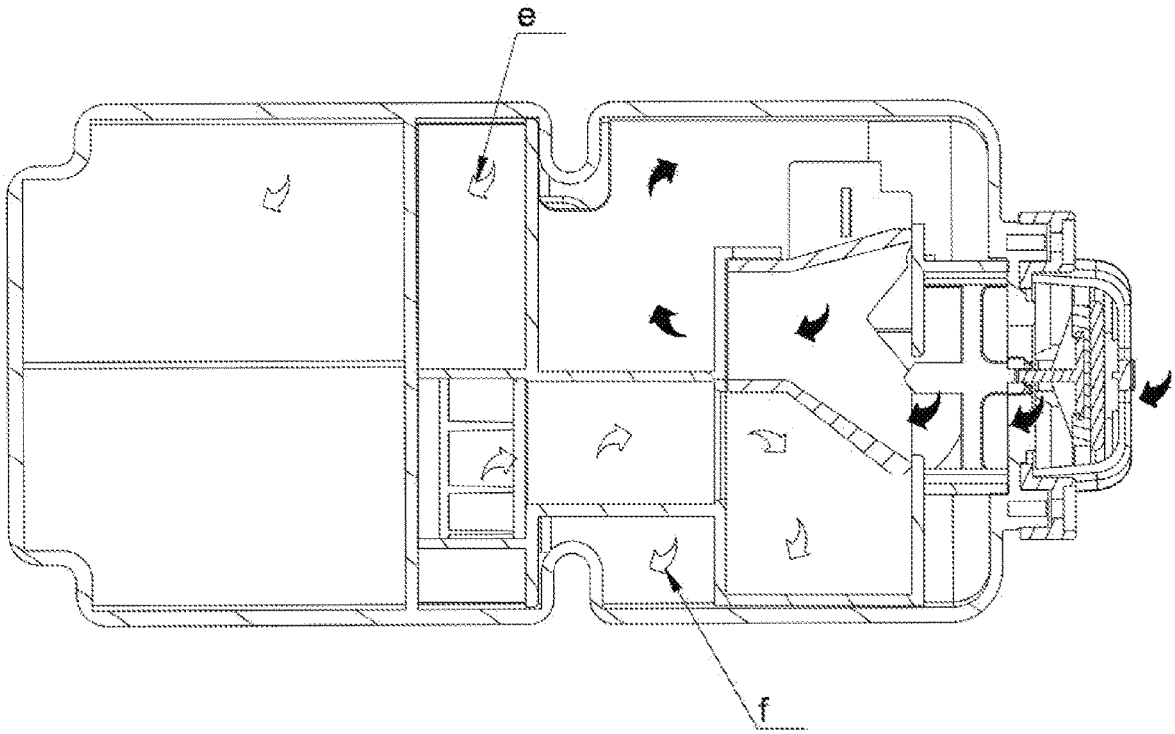
FIG. 12 is a schematic diagram of the present invention in deflated state according to the embodiment.
Figure 13:
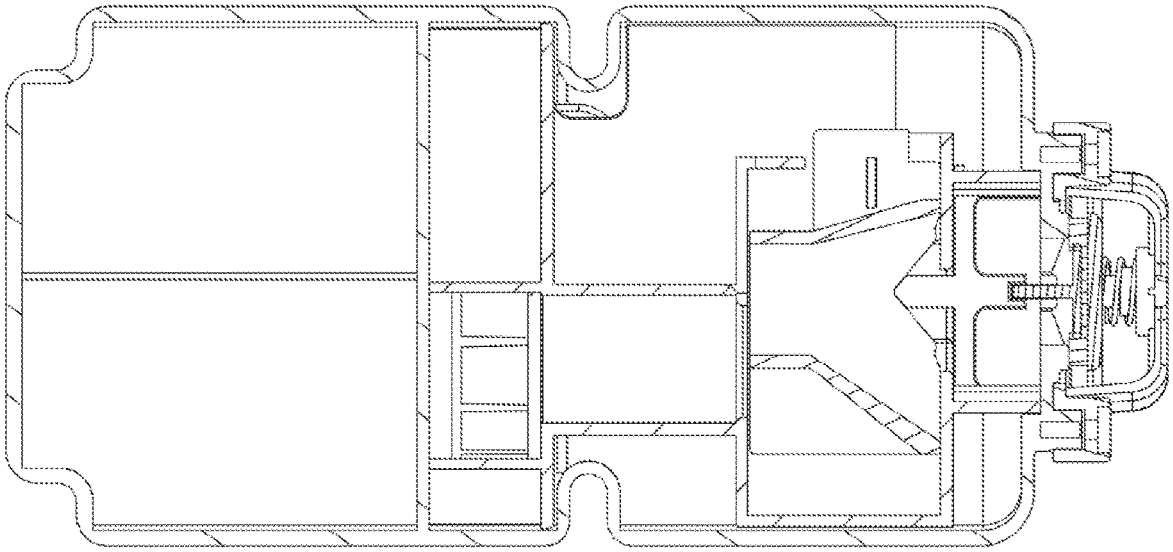
FIG. 13 is a schematic diagram of the present invention in stopped state according to the embodiment.

FIG. 12 shows the deflated state of the present invention, the knob mechanism is rotated, and the contact portion for a deflated state 633 of the air channel switching paddle 630 is brought into contact with the pressing switch 700 to turn on the circuit; at the same time, the air channel switching mechanism 300 moves upwards under the action of the blocking rod 640, so that the air inlet 301 of the air channel switching mechanism is not brought into contact with and is not communicated with the air outlet 212 of the fan blade chamber, the second inclined plane 322 of the air channel switching mechanism 300 operates an end of the first ejector rod 410, and the other end of the first ejector rod 410 operates the air valve mechanism 500 with the guiding of the second ejector rod 420; and the platen 520 of the air valve mechanism is compressed toward the mesh cover 510, and the second air inlet/outlet 111 is opened, thus carrying out deflating. The flow of the air in deflation is shown in FIG. 12, an arrow "e" indicates that the air flow enters the wire slot accommodating chamber from the assembly accommodating chamber through the gap and then is discharged through the gap between the cover plate and the panel; an arrow "f" indicates that the air flow exits from the outlet of the fan blade chamber and then is discharged through the first air inlet/outlet on the panel.

Figure 14:
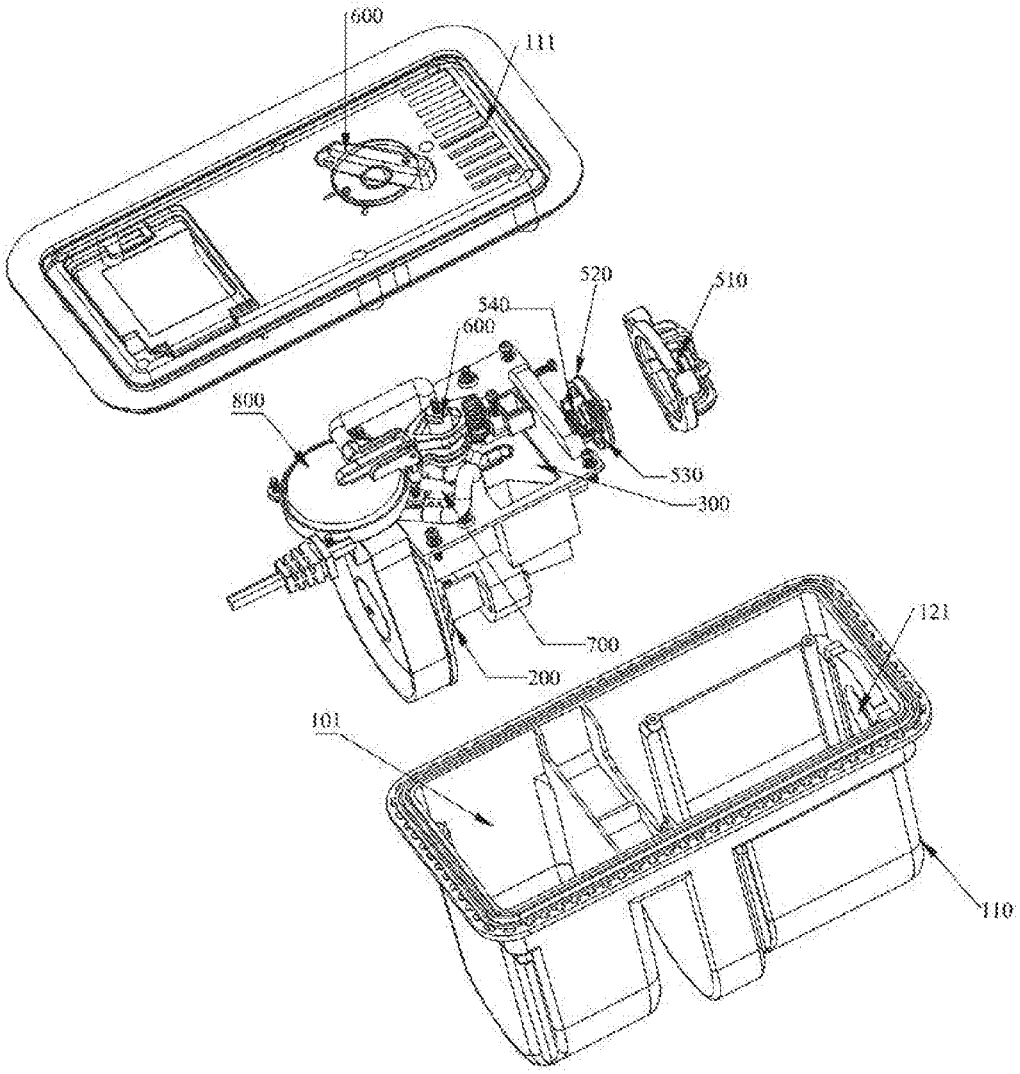
FIG. 14 is an exploded schematic view according to another embodiment.
Figure 15:
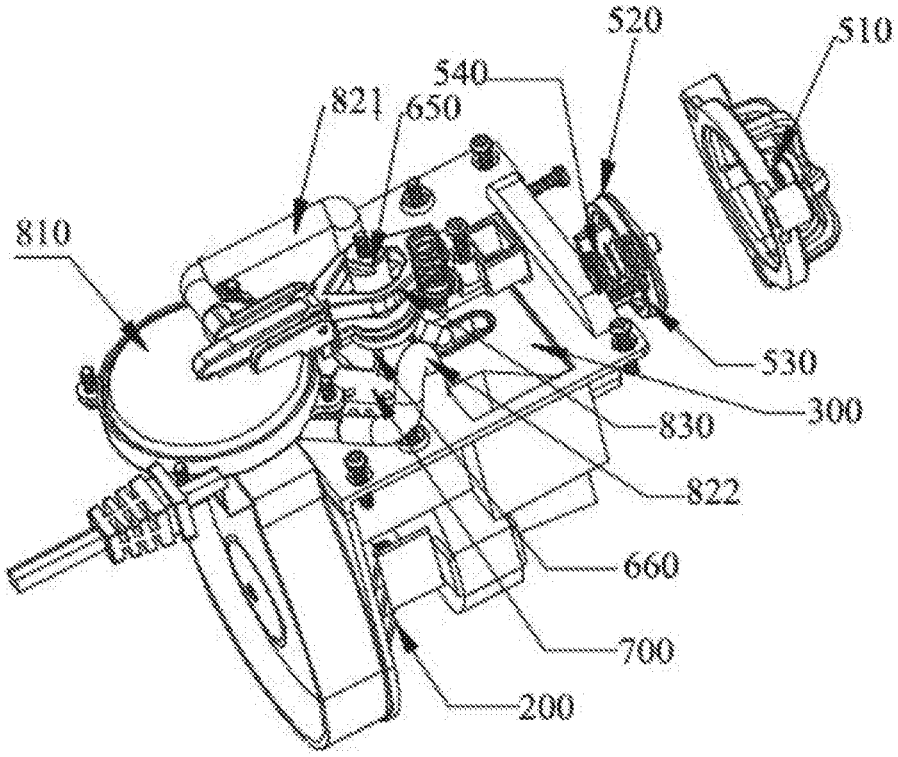
FIG. 15 is a schematic structural view of the embodiment in an inflated state.
Figure 16:
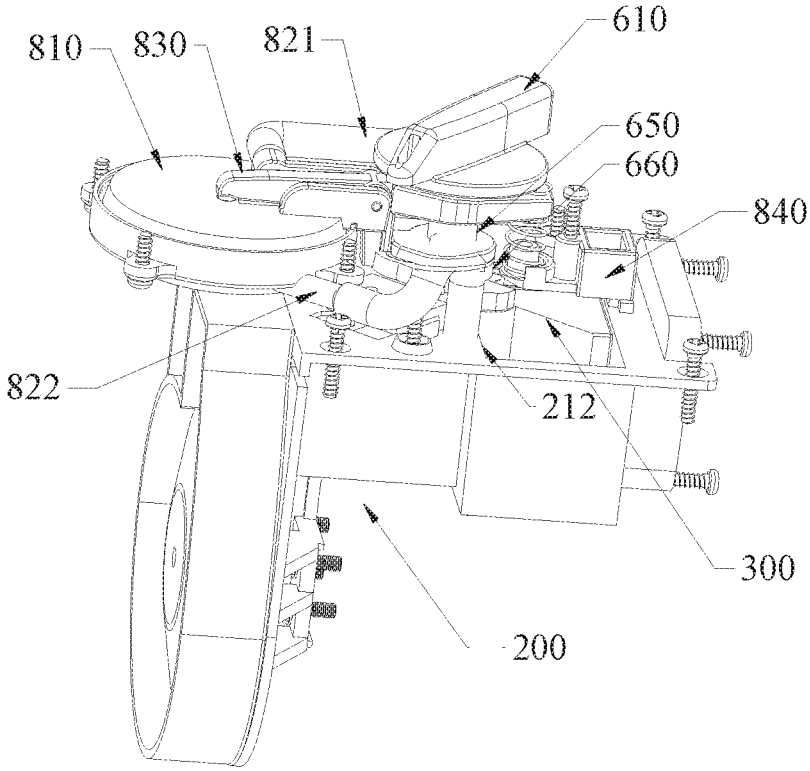
FIG. 16 is a schematic structural view of the embodiment in a deflated state.
Figure 17:
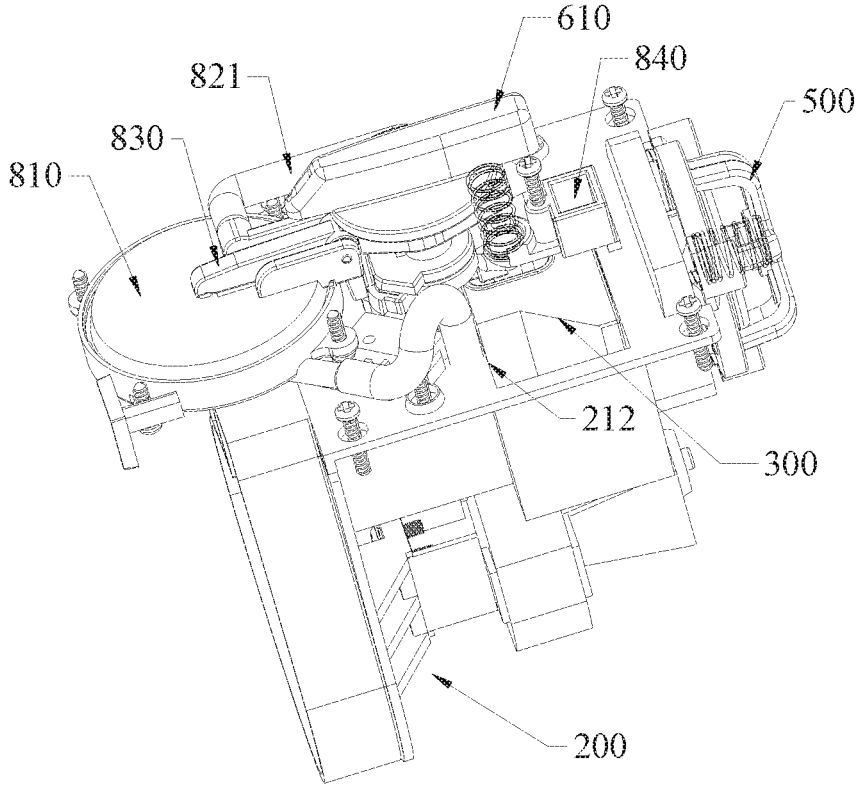
FIG. 17 is a schematic structural view of the embodiment in a stopped state.

According to an improved embodiment, an air pump capable of automatically stopping inflation and deflation is provided. In addition to the above structure, an inflation and deflation linkage 800 is added so as to achieve automatic stop of inflation and deflation. FIG. 14 is an exploded schematic view of the embodiment. In the present embodiment, in addition to the knob mechanism 600 and the air channel switching mechanism 300 which is connected to a product to be inflated or deflated through the second air inlet/outlet 111, the inflation and deflation linkage 800 is also provided in the housing. The inflation and deflation linkage 800 is operatively connected to the knob mechanism 600, and controls the air channel switching mechanism 300 to be operatively connected to the knob mechanism 600 which can control the displacement of the air channel switching mechanism 300 so as to be communicated with the product to be inflated or deflated to achieve inflation or deflation or to be not communicated with the product to be inflated or deflated to achieve automatic stop of inflation or deflation. When the knob mechanism 600 is fastened to the inflation and deflation linkage 800, the air channel switching mechanism 300 is communicated with the product to be inflated or deflated; and when the knob mechanism 600 is unfastened to the inflation and deflation linkage 800, the knob mechanism 600 rotates and the air channel switching mechanism 300 is not communicated with the product to be inflated or deflated. FIGS. 15 to 17 are schematic structural views of the air pump in inflated, deflated and stopped states respectively. With respect to how the inflation and deflation linkage 800 controls the air channel switching mechanism 300 to be operatively connected to the knob mechanism 600 which can control the displacement of the air channel switching mechanism 300 so as to be communicated with the product to be inflated or deflated to achieve inflation or deflation or to be not communicated with the product to be inflated or deflated to achieve automatic stop of inflation or deflation, detailed descriptions will be provided as follows with reference to the drawings.

Figure 18:
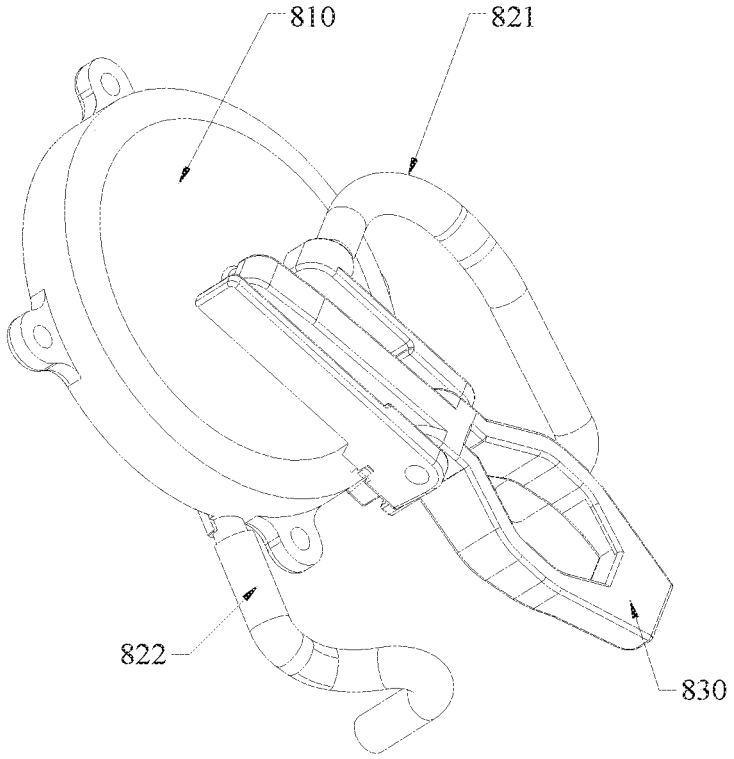
FIG. 18 is a schematic structural view of an inflation and deflation linkage according to the embodiment.

FIG. 18 is a schematic structural view of the inflation and deflation linkage 800. According to FIGS. 15 to 18, the inflation and deflation linkage 800 includes ducts 821 and 822 and a pressure valve 810. One end of the duct is communicated with the air pressure in the product to be inflated or deflated, and the other end is connected with the pressure valve 810 which is operatively connected to the knob mechanism. During inflation or deflation, the knob mechanism 600 is fastened to the inflation and deflation linkage 800. When the air pressure in the ducts 821 and 822 reaches a set pressure value, the pressure valve 810 moves upward, so that the knob mechanism 600 is unfastened to the inflation and deflation linkage 800, the knob mechanism 600 rotates and the air channel switching mechanism 300 is not communicated with the product to be inflated or deflated, and the automatic stop of inflation or deflation is achieved.

Figure 19:
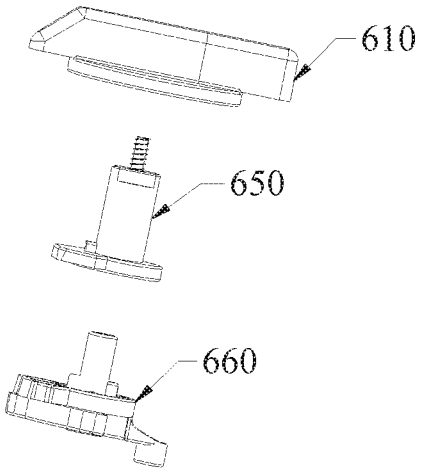
FIG. 19 is a schematic structural view of the knob mechanism according to the embodiment.

The knob mechanism 600 in the embodiment is improved for cooperation with the inflation and deflation linkage 800 to automatically stop inflation and deflation. FIG. 19 illustrates a schematic structural view of the knob mechanism 600 in the embodiment. With reference to FIGS. 15 to 17 and FIG. 18, the knob mechanism 600 includes a knob 610, an upper rotation rod 650 and a lower rotation rod 660, in which the knob 610 has three state selections including inflation, stop and deflation. The upper rotation rod 650 is sleeved on the lower rotation rod 660 and is connected to the knob 610; the lower rotation rod 660 is connected to the air channel switching mechanism 300 and is operatively connected to the pressure valve 810 to control the displacement of the air channel switching mechanism 300. Any one of the states is selected by rotating the knob 610, the upper rotation rod 650 rotates with the knob 610, and the lower rotation rod 660 rotates with the upper rotation rod 650 so as to drive the displacement of the air channel switching mechanism 300, and the air channel switching mechanism 300 is communicated or not communicated with the product to be inflated or deflated by the control of the pressure valve.

Figure 20:
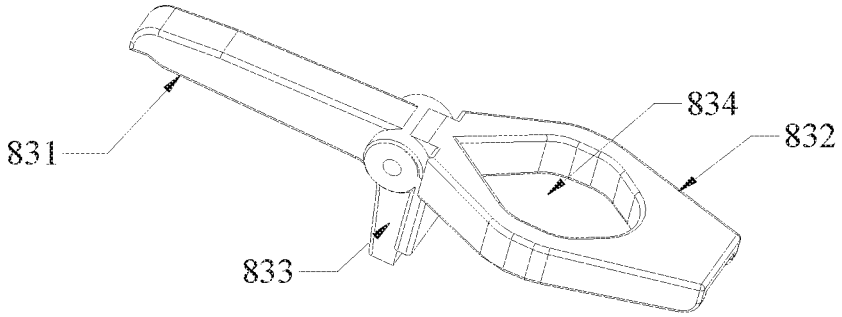
FIG. 20 is a schematic structural view of a control rod according to the embodiment.

As shown in FIG. 18, the inflation and deflation linkage 800 also includes a control rod 830, and FIG. 20 illustrates the structure of the control rod 830. As shown in FIG. 20, the control rod 830 with a T-shaped lever structure includes a first end portion 831 and a second end portion 832, and has a downward extension portion 833 movably fastened to the lower rotation rod 660. With reference to FIGS. 14 to 17, the first end portion 831 is connected with the pressure valve 810 which controls the movement of the first end portion 831. The second end portion 832 is connected with an elastic member 840, and a through hole 834 is provided in the middle part near the second end portion 832 for the upper rotation rod 650 to pass through. The middle part is movable connected with the pressure valve 810, such as by a hinge. The first end portion 831 can move with the pressure valve 810, and under the action of the elastic member 840, the extension portion 833 is fastened or unfastened to the lower rotation rod 660. For example, when the pressure valve 810 moves upward, the first end portion 831 connected to the pressure valve 810 follows to move upward, the second end portion 832 moves downward under the action of the elastic member 840, so that the extension portion 833 is unfastened to the lower rotation rod 660. After unfastening, the lower rotation rod 660 rotates; the upper rotation rod follows to rotate and drives the knob to rotate to the stopped state, so that the stop of inflation and deflation is achieved.

The ducts include a first duct 821 and a second duct 822, one end of the both is communicated with the pressure valve 810 at the top and bottom of the pressure valve 810 respectively, and the other end of the both is communicated with the air pressure in the product to be inflated or deflated. When the pressure in the first duct 821 reaches a set pressure value, the pressure valve 810 moves upward and drives the first end portion 831 of the control rod 830 to move upward, so that the extension portion 833 of the control rod 830 is unfastened to the lower rotation rod 660, the lower rotation rod 660 rotates and drives the air channel switching mechanism 300 to be not communicated with the product to be inflated or deflated, and the automatic stop of deflation is achieved. When the pressure in the second duct 822 reaches a set pressure value, the pressure valve 810 moves upward and drives the first end portion 831 of the control rod 830 to move upward, so that the extension portion 833 of the control rod 830 is unfastened to the lower rotation rod 660, the lower rotation rod 660 rotates and drives the air channel switching mechanism 300 to be not communicated with the product to be inflated or deflated, and the automatic stop of inflation is achieved.

Figure 21:
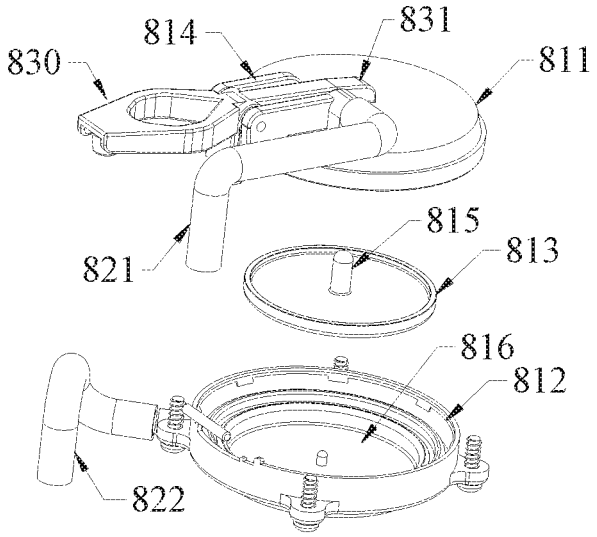
FIG. 21 is a schematic structural view of an air pressure valve according to the embodiment.

FIG. 21 is a schematic structural view of the pressure valve. The pressure valve 810 includes a first valve cover 811, a second valve cover 812, and a valve plate 816. The first valve cover 811 and the second valve cover 812 form a sealed chamber within which the valve plate 816 is provided and is movable up and down in the sealed chamber. The first valve cover is provided with a fixed base 814 that mounts the control rod 830, and the first duct 821 and the second duct 822 pass through the first valve cover 811 and the second valve cover 812 respectively to connect the sealed chamber. Above the valve plate 816, a pressure collecting element 813 is provided. The center of the pressure collecting element 813 is provided with a pressure collecting rod 815, which passes through the first valve cover 811 to connect the first end portion 831 of the control rod 830 and is used for collecting the air pressure values in the ducts. When the collected air pressure value reaches a set pressure value, the valve plate 816 moves upward, the pressure collecting rod 815 pushes the first end portion 831 to move upward, so that the lower rotation rod 660 which rotates the knob mechanism 600 is unfastened to the extension portion 833 of the control rod and rotates until the knob rotates to the stopped state, and thus the air channel switching mechanism is not communicated with the product to be inflated or deflated in order to achieve automatic stop of inflation or deflation.

Figure 22:
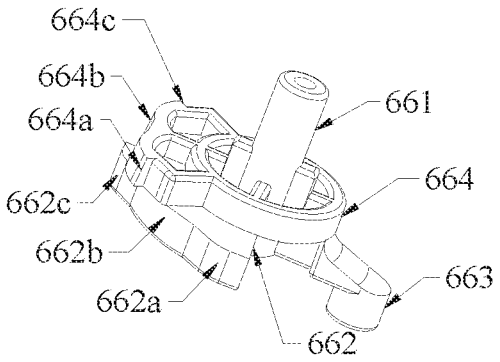
FIG. 22 is a schematic structural view of a lower rotation rod according to the embodiment.

FIG. 22 is a schematic structural view of the lower rotation rod in the embodiment. The lower rotation rod includes a blocking rod 661, an air channel switching paddle 662 and a connecting rod 663. The blocking rod 661 and the connecting rod 663 are provided on both sides of the air channel switching paddle 662 respectively. The upper rotation rod 650 is sleeved within the connecting rod 663, the blocking rod 661 is embedded in the sliding slot 310 of the air channel switching mechanism 300 and drives the displacement of the air channel switching mechanism 300 to be communicated or not communicated with the product to be inflated or deflated. The edge of the air channel switching paddle 662 is provided with a contact portion in an inflated state 662*a*, a non-contact portion in a stopped state 662*b*, and a contact portion in a deflated state 662*c*.

The lower rotation rod 660 is also provided with a first bump 664 movably fastened to the extension portion 833 of the control rod 830. The first bump 664 is provided above the air channel switching paddle 662, and the connecting rod 663 passes through the first bump 664. The edge of the first bump is provided with an inflated state fastening portion 664*a*, a stopped state non-fastening portion 664*b*, and a deflated state fastening portion 664*c*. When the inflated state fastening portion 664*a* or the deflated state fastening portion 664*c* of the first bump 664 is fastened to the extension portion 833 of the control rod 830, inflation or deflation is performed; and when the stop state non-fastening portion 664*b* of the first bump 664 is unfastened to the extension portion 833 of the control rod 830, inflation or deflation is stopped.

Figure 23:
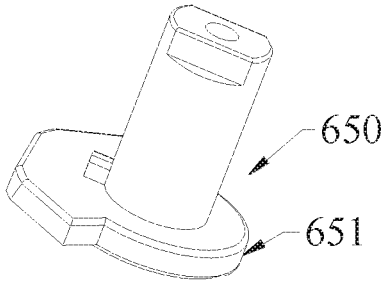
FIG. 23 is a schematic structural view of an upper rotation rod according to the embodiment.

FIG. 23 is a schematic structural view of the upper rotation rod 650. To more stabilize the knob mechanism 600, the end of the upper rotation rod 650 is formed with a second bump 651 that abuts the first bump 664. When inflation or deflation is performed, the second bump 651 abuts the extension portion 833 of the control rod 830, so that the knob mechanism is in an inflated or deflated state more stably; and when the inflation or deflation is stopped, the second bump 651 is disconnected with the extension portion 833 of the control rod 830.

An air extracting mechanism 200 is further provided in the housing, the blocking rod 661 drives the displacement of the air channel switching mechanism 300, so that the air outlet 212 of the air extracting mechanism 200 is communicated or not communicated with the air channel switching mechanism 300. When the air channel switching mechanism 300 is communicated with the air outlet 212 of the air extracting mechanism 200, inflation is performed; and when the air channel switching mechanism 300 is not communicated with the air outlet 212 of the air extracting mechanism 200, deflation is performed or in the stopped state.

Figure 24:
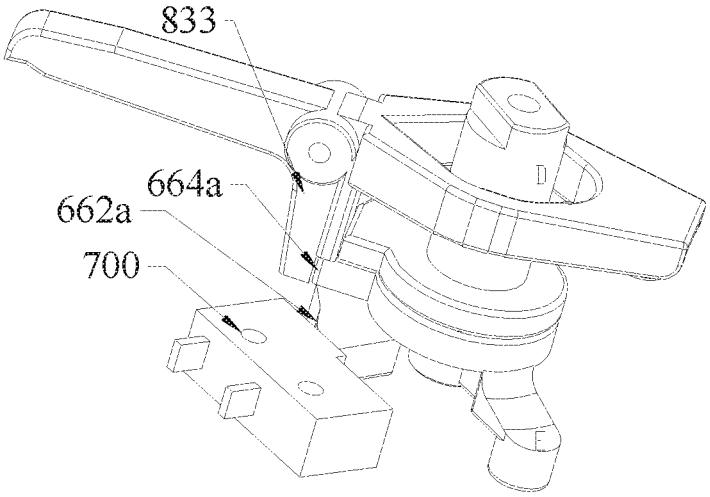
FIG. 24 is a schematic view of a combined structure of the control rod, the lower rotation rod and the pressing switch in an inflated state according to the embodiment.
Figure 25:
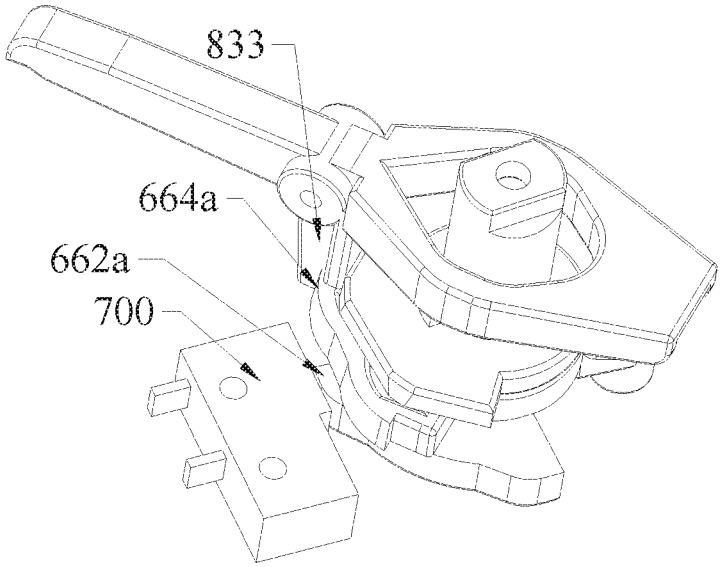
FIG. 25 is a schematic view of the combined structure of the control rod, the lower rotation rod and the pressing switch in a deflated state according to the embodiment.
Figure 26:
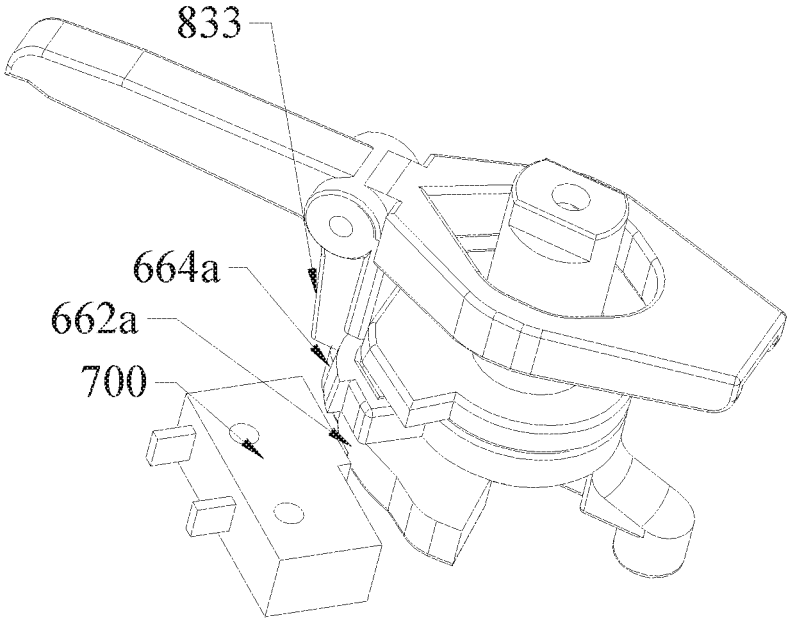
FIG. 26 is a schematic view of the combined structure of the control rod, the lower rotation rod and the pressing switch in a stopped state according to the embodiment.

The pressing switch 700 for controlling the operation of the air extracting mechanism 200 is provided near the air channel switching paddle 662. FIGS. 24 to 26 are schematic views of the cooperation among the lower rotation rod 660, the control rod 830, and the pressing switch 700 in the inflated, deflated and stopped state respectively. As shown in FIG. 24, in the inflated state, the inflated state fastening portion 664*a* of the lower rotation rod 660 is fastened to the extension portion of the control rod, while the contact portion in an inflated state 631 is in contact with the pressing switch 700 which turns the circuit on, the air extracting mechanism starts to work, and the air channel switching mechanism 300 is communicated with the air outlet 212 of the air extracting mechanism 200. As shown in FIG. 25, in the deflated state, the inflated state fastening portion 664*c* of the lower rotation rod 660 is fastened to the extension portion 833 of the control rod, the contact portion in a deflated state 633 is in contact with the pressing switch 700 which turns the circuit on, the air extracting mechanism 200 starts to work, and the air channel switching mechanism 300 is not communicated with the air outlet 212 of the air extracting mechanism 200. As shown in FIG. 26, in the stopped state, the lower rotation rod 660 is unfastened to the extension portion 833 of the control rod, the extension portion 833 is at the stopped state non-fastening portion 664*b* of the lower rotation rod 660. Meanwhile, the non-contact portion in a stopped state 632 is separated from the pressing switch 700, the circuit is turned off, and the air extracting mechanism 200 stops working.

The second air inlet/outlet 212 is connected with the air valve mechanism 500, the air channel switching mechanism 500 is connected with the product to be inflated or deflated through the air valve mechanism 500 under the action of the ejector rod mechanism 400. The ejector rod mechanism 400 moves with the air channel switching mechanism 300, and is in an abutting or non-abutting state with the air valve mechanism. When the ejector rod mechanism and the air valve mechanism are in the abutting state, the air valve mechanism is communicated with the product to be inflated or deflated, and the inflation or deflation is performed; and when the ejector rod mechanism and the air valve mechanism are in the non-abutting state, the air valve mechanism is not communicated with the product to be inflated or deflated, and the inflation or deflation is stopped.

The air extracting mechanism 200, the air channel switching mechanism 300, the ejector rod mechanism 400, and the pressing switch 700 described in the embodiment have the same structure as that in the embodiment shown in FIGS. 1 to 13.

As shown in FIG. 4, the air valve mechanism 500 includes a breathable mesh cover 510 arranged on the second air inlet/outlet 111, and a seal assembly capable of being compressed or reset by the ejector rod mechanism 400 is arranged in the mesh cover 510. When the seal assembly is in a compressed state, the seal assembly opens the second air inlet/outlet 111, so that the air channel switching mechanism 300 is communicated with the product to be inflated or deflated; or when the seal assembly is in a reset state, the seal assembly closes the second air inlet/outlet 111, so that the air channel switching mechanism 300 is not communicated with the product to be inflated or deflated.

The seal assembly includes the platen 520 arranged in the mesh cover, the seal ring 530 used for sealing and the guide rod 521 which can penetrate the mesh cover are provided on the platen 520, and the spring 540 is sleeved outside the guide rod 521 and between the platen 520 and the mesh cover 510. The spring 540 is stretched and compressed by the platen 520 under the action of the ejector rod mechanism 400. When the spring 540 is not compressed, the mesh cover 510 closes the second air inlet/outlet 111, and the air channel switching mechanism 300 is not communicated with the product to be inflated or deflated; and when the spring 540 is compressed by forces, the mesh cover 510 opens the second air inlet/outlet 111, the air channel switching mechanism 300 is communicated with the product to be inflated or deflated, and the reverse elastic force generated by compressing the spring 540 acts on the knob mechanism 600 through the ejector rod mechanism 400 and the air channel switching mechanism 300, so that the knob mechanism 600 is caused to generate a greater rotational force to facilitate the knob mechanism 600 to be unfastened to the inflation and deflation linkage 800.

The process of automatic stop of inflation using the present air pump is as follows.

The knob 610 is rotated to the inflated state and drives the upper rotation rod 650 to rotate, the lower rotation rod 660 rotates with the upper rotation rod 650 and drives the displacement of the air channel switching mechanism 300 during the rotation. The ejector rod mechanism 400 moves with the air channel switching mechanism 300, one end of the first ejector rod 410 of the ejector rod mechanism 400 abuts against the first inclined plane 321 of the air outlet of the air channel switching mechanism 300, and the other end abuts against the guide rod 521 of the air valve mechanism 500. The guide rod 521 acts on the platen 520 to compress the spring 540, so that the second air outlet 111 is communicated with the product to be inflated. Meanwhile, the inflated state fastening portion 664*a* of the first bump 664 on the lower rotation rod 660 is fastened to the extension portion 833 of the control rod 830 of the inflation and deflation linkage 800, the contact portion in an inflated state 662*a* of the air channel switching paddle 662 abuts the pressing switch 700, and the air extracting mechanism 200 starts to inflate the inflatable product.

During inflation, the air pressure of the second duct 822 gradually increases and slowly pushes the pressure valve 810 to rise. When the air pressure of the second duct 822 reaches the set pressure value, the pressure collecting rod 815 on the valve plate 816 of the pressure valve 810 pushes up the first end portion 831 of the control rod 830 of the inflation and deflation linkage 800, so that the lower rotation rod 660 is unfastened to the extension portion 833 of the control rod 830 and rotates. Meanwhile, the reverse elastic force generated by compressing the spring 540 of the air valve mechanism 500 acts on the knob mechanism 600 through the first ejector rod 410 and the air channel switching mechanism 300 to accelerate the rotation of the lower rotation rod 660, and the rotation of the lower rotation rod 660 drives the upper rotation rod 650 to rotate until the knob is in a stopped state. During rotation, the lower rotation rod 660 drives the displacement of the air channel switching mechanism 300, the second ejector rod 420 of the ejector rod mechanism moves with the air channel switching mechanism 300. One end of the first ejector rod 410 of the ejector rod mechanism does not abut against the air outlet of the air channel switching mechanism 300, the other end does not abut against the guide rod 521 of the air valve mechanism, so that the second air inlet/outlet 111 is not communicated with the product to be inflated while the non-contact portion in a stopped state 662*b* of the air channel switching paddle 662 is separated from the pressing switch 700, and the air extracting mechanism 200 stops working and no longer performs inflation.

The process of automatic stop of deflation using the present air pump is as follows.

The knob 610 is rotated to the deflated state and drives the upper rotation rod 650 to rotate, the lower rotation rod 660 rotates with the upper rotation rod 650 and drives the displacement of the air channel switching mechanism 300 during the rotation. The ejector rod mechanism 400 moves with the air channel switching mechanism 300, one end of the first ejector rod 410 of the ejector rod mechanism 400 abuts against the second inclined plane 322 of the air outlet of the air channel switching mechanism 300, and the other end abuts against the guide rod 521 of the air valve mechanism 500. The guide rod 521 acts on the platen 520 to compress the spring 540, so that the second air outlet 111 is communicated with the product to be inflated. Meanwhile, the deflated state fastening portion 664*c* of the first bump 664 on the lower rotation rod 660 is fastened to the extension portion 833 of the control rod 830 of the inflation and deflation linkage 800, the contact portion in an inflated state 662*a* of the air channel switching paddle 662 abuts the pressing switch 700, and the air extracting mechanism 200 starts to deflate the product to be inflated.

During deflation, the air pressure in the first duct 821 gradually decreases and the pressure valve 810 slowly rises due to the negative pressure in the first duct 821. When the air pressure of the first duct 821 decreases to the set pressure value, the pressure collecting rod 815 on the valve plate 816 of the air pressure valve 810 pushes up the first end portion 831 of the control rod 830 of the inflation and deflation linkage 800, so that the lower rotation rod 660 is unfastened to the extension portion 833 of the control rod 830 and rotates. Meanwhile, the reverse elastic force generated by compressing the spring 540 of the air valve mechanism 500 acts on the knob mechanism 600 through the first ejector rod 410 and the air channel switching mechanism 300 to accelerate the rotation of the lower rotation rod 660, and the rotation of the lower rotation rod 660 drives the upper rotation rod 650 to rotate until the knob is in a stopped state. During rotation, the lower rotation rod 660 drives the displacement of the air channel switching mechanism 300, the second ejector rod 420 of the ejector rod mechanism 400 moves with the air channel switching mechanism. One end of the first ejector rod 410 of the ejector rod mechanism does not abut against the air outlet of the air channel switching mechanism 300, the other end does not abut against the guide rod 521 of the air valve mechanism 500, so that the second air inlet/outlet 111 is not communicated with the product to be inflated while the non-contact portion in a stopped state 662*b* of the air channel switching paddle 662 is separated from the pressing switch 700, and the air extracting mechanism 200 stops working and no longer performs deflation.

Figure 27:
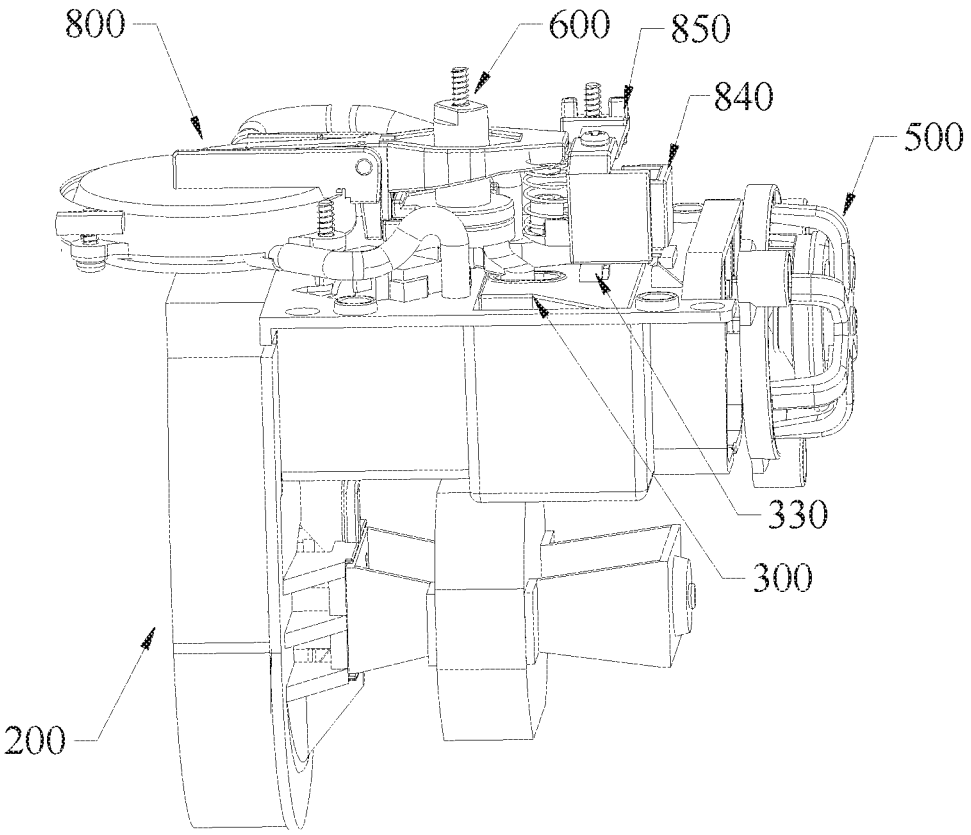
FIG. 27 is a schematic structural view of another embodiment in an inflated state.
Figure 28:
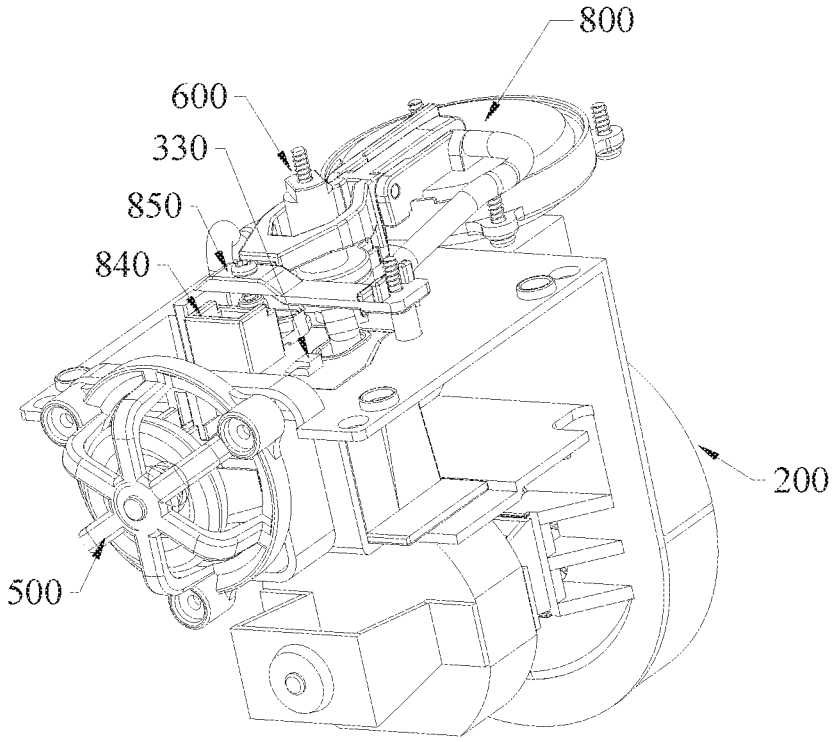
FIG. 28 is a schematic structural view of the embodiment in a deflated state according to the embodiment.

According to another improved embodiment, in order to increase the stability of the air pump, a pressure regulating device 850 is provided on the elastic member 840 used for adjusting the air pressure of the pressure valve 810 to move upward. The elastic member 840 moves with the pressure regulating device 850 and changes the compressed elastic force of the elastic member 840, and the elastic force acts on the control rod 830, so that the first end portion 831 presses against the pressure valve 810 and the pressure valve 810 requires greater air pressure to move. In particular, the air pressure that moves the air pressure valve upward when stopping the inflation is increased. FIGS. 27 and 28 illustrate the air pump (not showing the housing) in an inflated or deflated state with the pressure regulating device 850, and FIG. 29 is a schematic structural view of the elastic member 840 and the pressure regulating device 850 when not assembled.

Figure 29:
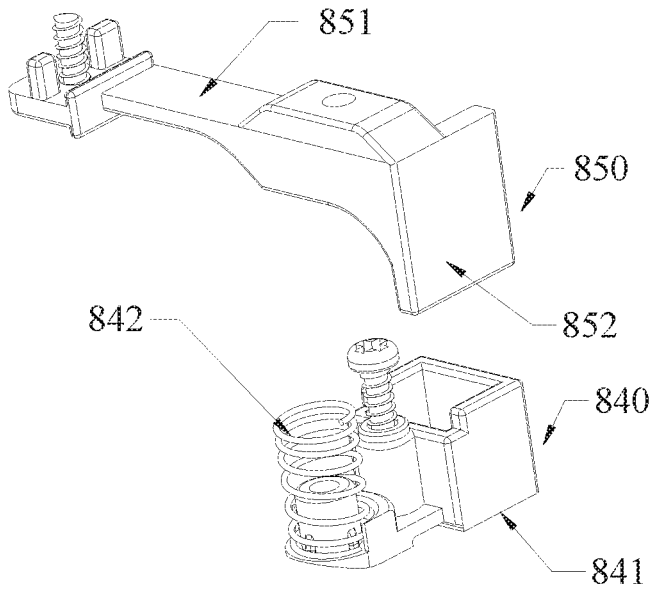
FIG. 29 is a schematic structural view of the embodiment in which a spring base is separated from a rocker according to the embodiment.
Figure 30:
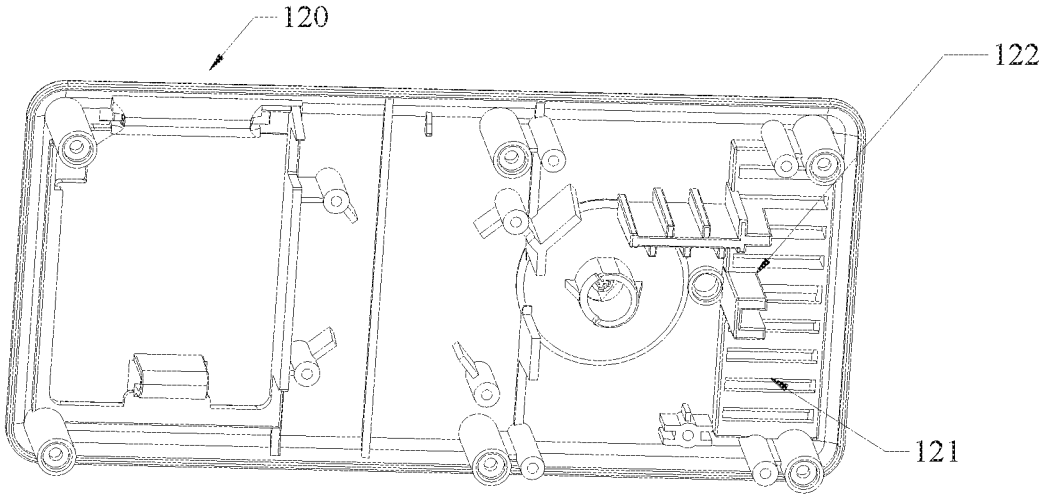
FIG. 30 is a schematic structural view of a panel according to the embodiment.
Figure 31:
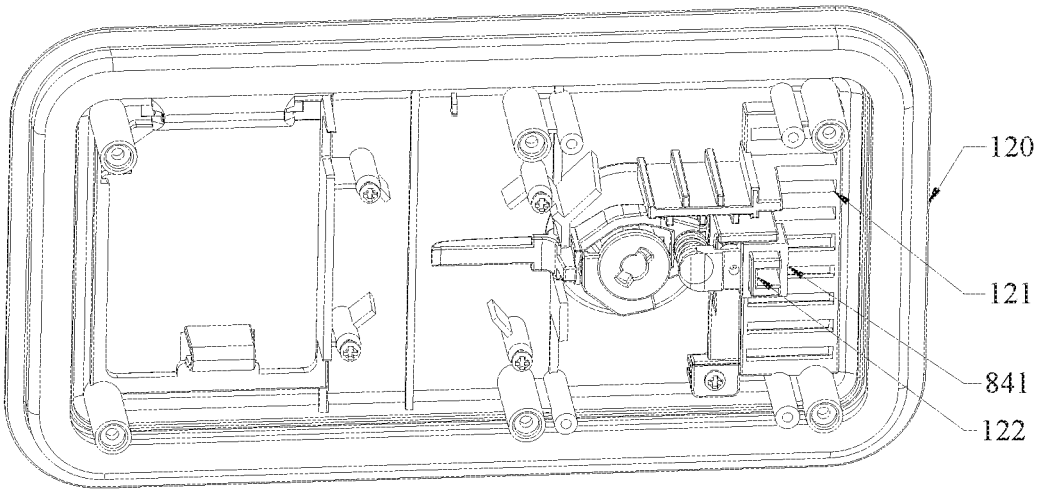
FIG. 31 is a schematic structural view of the panel mounted with the spring base according to the embodiment.

As shown in FIG. 29, the elastic member 840 includes a spring base 841, which is movably connected to the panel 120 of the housing, and a pressure regulating spring 842 connected to the second end portion of the control rod. One end of the spring base 841 is connected with the pressure regulating spring 842, and the other end is formed with a square hole structure which is limited on the panel 120, so that the spring base 841 cannot rotate, the middle part of the spring base 841 is connected with the pressure regulating device 850, and the spring base 841 can move with the pressure regulating device 850. The middle part of the spring base 841 in the present embodiment is suspended from the panel 120 by screws, the square hole structure is limited to a U-shaped structure 123 on the panel 120, and FIG. 31 illustrates how the pressure regulating device is mounted on the spring base and how the spring base is mounted on the panel. The structure of the panel 120 is shown in FIGS. 30 and 31. The pressure regulating device 850 in the present embodiment is a rocker movably connected with the spring base. The rocker has an L-shaped structure, including a cross bar 850 and a protrusion portion 852 that is formed at one end portion of the cross bar 850 and extends downward. A protrude portion 330 is provided on the air channel switching mechanism 300 and near the sliding slot 310, and the rocker cooperates with the protrude portion 330 to adjust the air pressure of the pressure valve 810 to move upward.

Referring to FIG. 28, in the inflated state, due to the movement of the air channel switching mechanism 300, the protrude portion 330 on the air channel switching mechanism 300 pushes the protrude portion 330 of the rocker upward, the rocker drives the spring base 841 to move upward, the pressure regulating spring 842 is compressed upward, and the elastic force acts to move the second end portion 832 of the control rod 830 upward. The first end portion 831 moves downward with the lever effect and is caused to press against the pressure valve 810, so that a higher air pressure is required to drive the pressure valve 810 to move upward by moving the first end portion 831 upward. Then the lower rotation rod 660 is unfastened to the extension portion 833 of the control rod 830, and the inflation is automatically stopped. With the arrangement of the rocker, the stability of the inflation is improved, and the product to be inflated is ensured to be sufficiently inflated.

Referring to FIG. 29, in the deflated state, due to the movement of the air channel switching mechanism 300, the protrude portion 330 moves away from the rocker so as not to push up the rocker, the rocker does not drive the spring base 841 to move upward, and the pressure regulating spring 842 is not forced to be compressed too much, so that the air pressure driving the pressure valve to move upward does not change. A smaller air pressure can move the air pressure valve upward, improve the stability of deflation, and ensure that the product to be deflated can complete the deflation.

The above embodiment is only a specific implementation of the present invention. Although the descriptions thereof are specific and detailed, they should not be construed as a limitation of the scope of the present invention. It should be noted that for a person of ordinary skill in the art, several variations and improvements may be made without departing from the spirit of the present invention. These obvious alternatives are intended to be included in the scope of protection of the present invention.

The invention claimed is:

1. An air pump with automatic stop of inflation and deflation, comprising:

a housing provided with a first air inlet/outlet and a second air inlet/outlet, wherein the housing is provided with a knob mechanism, an inflation and deflation linkage, and an air channel switching mechanism which is connected to a product to be inflated or deflated through the second air inlet/outlet, wherein the inflation and deflation linkage controls the air channel switching mechanism to be operatively connected to the knob mechanism which is adapted to control a displacement of the air channel switching mechanism so as to be communicated with the product to be inflated or deflated to achieve inflation or deflation or not to be communicated with the product to be inflated or deflated to achieve automatic stop of inflation or deflation, wherein the air channel switching mechanism is communicated with the product to be inflated or deflated when the knob mechanism is fastened to the inflation and deflation linkage, and the knob mechanism rotates and the air channel switching mechanism is not communicated with the product to be inflated or deflated when the knob mechanism is unfastened to the inflation and deflation linkage, and wherein the inflation and deflation linkage includes ducts and a pressure valve, one end of each of the ducts is communicated with the air pressure in the product to be inflated or deflated, the other end of each of the ducts is connected with the pressure valve, and the pressure valve moves and controls the knob mechanism to rotate when the air pressure in either of the ducts reaches a set pressure value, so that the air channel switching mechanism is not communicated with the product to be inflated or deflated, thereby achieving automatic stop of inflation or deflation.

2. The air pump according to claim 1, wherein the knob mechanism includes a knob, an upper rotation rod and a lower rotation rod, the upper rotation rod is sleeved on the lower rotation rod and is connected to the knob, the lower rotation rod is connected to the air channel switching mechanism, the upper rotation rod rotates by rotating the knob, and the lower rotation rod rotates with the upper rotation rod so as to drive the displacement of the air channel switching mechanism, and make the air channel switching mechanism communicate or not communicate with the product to be inflated or deflated.

3. The air pump according to claim 2, wherein the inflation and deflation linkage also includes a control rod with a T-shaped lever structure, the control rod includes a first end portion and a second end portion, and a middle portion of the control rod forms an extension portion downward which is movably fastened to the lower rotation rod, a through hole passing through control rod is arranged in the middle portion of the control rod near the second end portion, and the middle portion is movably connected with the pressure valve, and wherein the first end portion is connected to the pressure valve that controls up-and-down movement of the first end portion, the second end portion is connected with an elastic member, the extension portion is fastened or unfastened to the lower rotation rod through the movement of the first end portion, the inflation or deflation is performed when the extension portion of the control rod is fastened to the lower rotation rod, and the inflation or deflation is stopped when the extension portion of the control rod is unfastened to the lower rotation rod.

4. The air pump according to claim 3, wherein a pressure regulating device is provided on the elastic member used for adjusting an air pressure of the pressure valve to move upward, the elastic member moves with the pressure regulating device and changes a compressed elastic force of the elastic member, and the elastic force acts on the control rod, so that the first end portion presses against the pressure valve which requires greater air pressure to move.

5. The air pump according to claim 4, wherein a sliding slot is arranged on the air channel switching mechanism, the lower rotation rod is connected to the air channel switching mechanism by the sliding slot, a protrude portion is provided on the air channel switching mechanism and near the sliding slot, the pressure regulating device is a rocker movably connected with the elastic member, and the rocker cooperates with the protrude portion to adjust the air pressure of the pressure valve to move upward, when in an inflated state, the protrude portion pushes the rocker upward, the elastic member is compressed upward, the elastic force acts to move the second end portion of the control rod upward, and the first end portion moves downward, so that the first end portion is pressed against the pressure valve, and the air pressure is increased to drive the pressure valve to move upward.

6. The air pump according to claim 5, wherein the elastic member comprise a spring base movably connected to the housing and a spring connected to the second end portion of the control rod, one end of the spring base is connected with the spring while the other end is limited to the housing, a middle part of the spring base is connected with the pressure regulating device, and the spring base moves with the pressure regulating device, and wherein the pressure regulating device is the rocker movably connected with the spring base, the rocker has an L-shaped structure comprising a cross bar, one end portion of the cross bar extends downward to form a protrusion portion, and the middle part of the spring base passes through the cross bar.

7. The air pump according to claim 3, wherein the lower rotation rod comprises a blocking rod, an air channel switching paddle and a connecting rod, the blocking rod and the connecting rod are provided on both sides of the air channel switching paddle respectively, the upper rotation rod is sleeved within the connecting rod, the blocking rod is embedded in the air channel switching mechanism and drives the displacement of the air channel switching mechanism to be communicated or not communicated with the product to be inflated or deflated.

8. The air pump according to claim 7, wherein an air extracting mechanism is further provided in the housing, the blocking rod drives the displacement of the air channel switching mechanism and make an air outlet of the air extracting mechanism communicate or not communicate with the air channel switching mechanism, inflation is performed when the air channel switching mechanism is communicated with the air outlet of the air extracting mechanism, and deflation is performed or in the stopped state when the air channel switching mechanism is not communicated with the air outlet of the air extracting mechanism, wherein a pressing switch that controls the air extracting mechanism to operate is arranged near the air channel switching paddle, an edge of the air channel switching paddle is provided with a contact portion in an inflated state, and a contact portion in a deflated state and a non-contact portion in a stopped state, wherein in the inflated state, the contact portion in the inflated state is in contact with the pressing switch which turns on the circuit, and the air channel switching mechanism is communicated with the air outlet of the air extracting mechanism, wherein in the deflated state, the contact portion in the deflated state is in contact with the pressing switch which turns on the circuit, and wherein in the stopped state, the non-contact portion in the stopped state is separated from the pressing switch.

9. The air pump according to claim 7, wherein the lower rotation rod is further provided with a first bump movably fastened to the lower portion of the control rod, the first bump is provided above the air channel switching paddle, the connecting rod passes through the first bump, and wherein inflation or deflation is performed when the first bump is fastened to the extension portion of the control rod, and inflation or deflation is stopped when the first bump is unfastened to the extension portion of the control rod.

10. The air pump according to claim 9, wherein an end of the upper rotation rod is formed with a second bump, the second bump abuts the first bump and abuts or not abuts the extension portion of the control rod, wherein the second bump abuts the extension portion of the control rod when inflation or deflation is performed, and the second bump is disconnected with the extension portion of the control rod when the inflation or deflation is stopped.

11. The air pump according to claim 3, wherein the ducts include a first duct and a second duct, one end of each of the first duct and the second duct is connected with a top and a bottom of the pressure valve respectively, and the other end of each of the ducts is connected with the air channel switching mechanism wherein when the pressure in the first duct reaches the set pressure value, the pressure valve moves upward and drives the first end portion of the control rod to move upward, so that the extension portion of the control rod is unfastened to the lower rotation rod, the lower rotation rod rotates and drives the air channel switching mechanism to be not communicated with the product to be inflated or deflated, and the automatic stop of deflation is achieved, and wherein when the pressure in the second duct reaches the set pressure value, the pressure valve moves upward and drives the first end portion of the control rod to move upward, so that the extension portion of the control rod is unfastened to the lower rotation rod, the lower rotation rod rotates and drives the air channel switching mechanism to be not communicated with the product to be inflated or deflated, and the automatic stop of inflation is achieved.

12. The air pump according to claim 1, wherein the pressure valve includes a first valve cover, a second valve cover and a valve plate, the first valve cover and the second valve cover form a sealed chamber within which the valve plate is provided, one end of the ducts passes through the first valve cover and the second valve cover respectively, and the valve plate moves upward when the air pressure in the ducts reaches the set pressure value.

13. The air pump according to claim 12, wherein the inside of the valve plate is provided with a pressure collecting element that collects the air pressure values in the ducts, the valve plate controls and rotates the knob mechanism when the collected air pressure value reaches the set pressure value, so that the air channel switching mechanism is not communicated with the product to be inflated or deflated in order to achieve automatic stop of inflation or deflation.

14. The air pump according to claim 1, wherein the air channel switching mechanism is connected with the product to be inflated or deflated through an air valve mechanism under an action of an ejector rod mechanism, the ejector rod mechanism moves with the air channel switching mechanism and is in an abutting or non-abutting state with the air valve mechanism, wherein the air valve mechanism is communicated with the product to be inflated or deflated and the inflation or deflation is performed when the ejector rod mechanism and the air valve mechanism are in the abutting state, and the air valve mechanism is not communicated with the product to be inflated or deflated and the inflation or deflation is stopped when the ejector rod mechanism and the air valve mechanism are in the non-abutting state.

15. The air pump according to claim 14, wherein an air outlet of the air channel switching mechanism has a V-shaped structure including a first inclined plane and a second inclined plane, the first inclined plane abuts against the ejector rod mechanism in the inflated state, and the second inclined plane abuts the ejector rod mechanism in the deflated state.

16. The air pump according to claim 15, wherein the ejector rod mechanism includes a first ejector rod and a second ejector rod intersecting with each other, a pair of guide slots are arranged in the housing, two ends of the second ejector rod are embedded in the guide slots, one end of the first ejector rod can abut against the first inclined plane or the second inclined plane of the air channel switching mechanism, and the other end can operate the air valve mechanism, so that the first inclined plane abuts against one end of the first ejector rod and the other end of the first ejector rod can operate the air valve mechanism in the inflated state, and the second inclined plane abuts against one end of the first ejector rod and the other end of the first ejector rod can operate the air valve mechanism in the deflated state.

17. The air pump according to claim 14, wherein the air valve mechanism includes a breathable mesh cover arranged on the second air inlet/outlet, and a seal assembly capable of being compressed or reset by the ejector rod mechanism is arranged in the mesh cover, the seal assembly opens the second air inlet/outlet such that the air channel switching mechanism is communicated with the product to be inflated or deflated when the seal assembly is in a compressed state, or the seal assembly closes the second air inlet/outlet such that the air channel switching mechanism is not communicated with the product to be inflated or deflated when the seal assembly is in a reset state.

18. The air pump according to claim 17, wherein the seal assembly includes a platen arranged in the mesh cover, a seal ring used for sealing and a guide rod which can penetrate the mesh cover are provided on the platen, and a spring is sleeved outside the guide rod and between the platen and the mesh cover, and the spring is stretched and compressed by the platen under the action of the ejector rod mechanism, and wherein the mesh cover closes the second air inlet/outlet and the air channel switching mechanism is not communicated with the product to be inflated or deflated when the spring is stretched, and the mesh cover opens the second air inlet/outlet and the air channel switching mechanism is communicated with the product to be inflated or deflated when the spring is compressed by forces, so that the reverse elastic force generated by compressing the spring acts on the knob mechanism through the ejector rod mechanism and the air channel switching mechanism, the knob mechanism is caused to generate a greater rotational force to facilitate the knob mechanism to be unfastened to the inflation and deflation linkage.

19. The air pump according to claim 1, wherein the housing comprises a wire slot accommodating chamber and an assembly accommodating chamber, the housing comprises a housing base and a panel, the panel is provided with a detachable cover plate, and the cover plate corresponds to the wire slot accommodating chamber, and wherein the second air inlet/outlet is arranged on the housing base, and the first air inlets/outlet is arranged on the panel corresponding to the assembly accommodating chamber.

* * * * *